US006758462B2

(12) United States Patent
Bellas et al.

(10) Patent No.: US 6,758,462 B2
(45) Date of Patent: Jul. 6, 2004

(54) CARBONATION SYSTEM AND METHOD

(75) Inventors: Richard F. Bellas, Stamford, CT (US); Jeffrey D. Derby, Waukesha, WI (US)

(73) Assignee: PepsiCo, Inc., Purchase, NY (US)

( * ) Notice: Subject to any disclaimer, the term of this patent is extended or adjusted under 35 U.S.C. 154(b) by 98 days.

(21) Appl. No.: 09/978,019

(22) Filed: Oct. 17, 2001

(65) Prior Publication Data

US 2003/0071376 A1 Apr. 17, 2003

(51) Int. Cl.[7] ..... B01F 3/04

(52) U.S. Cl. ..... 261/78.2; 261/115; 261/119.1; 261/DIG. 7; 426/477

(58) Field of Search ..... 261/37, 78.1, 78.2, 261/2, 115, 118, 119.1, DIG. 7; 426/477

(56) References Cited

U.S. PATENT DOCUMENTS

| | | | | |
|---|---|---|---|---|
| 487,342 | A | * | 12/1892 | Wittemann |
| 723,453 | A | * | 3/1903 | Fletcher |
| 793,707 | A | * | 7/1905 | Wultze |
| 955,182 | A | * | 4/1910 | Michal |
| 984,212 | A | * | 2/1911 | Gray |
| 1,055,648 | A | * | 3/1913 | Murphy |
| 1,269,130 | A | * | 6/1918 | Thomas |
| 2,420,795 | A | | 5/1947 | Phillips |
| 2,588,677 | A | | 3/1952 | Welty et al. |
| 2,650,808 | A | | 9/1953 | Cohen et al. |
| 2,735,720 | A | * | 2/1956 | Evert |
| 3,761,065 | A | | 9/1973 | Rich et al. |
| 4,070,424 | A | | 1/1978 | Olson et al. |
| 4,083,932 | A | | 4/1978 | Muraco et al. |
| 4,140,501 | A | | 2/1979 | Ekman |
| 4,212,654 | A | | 7/1980 | Caraway et al. |
| 4,411,846 | A | | 10/1983 | Ulrich et al. |
| 4,735,750 | A | * | 4/1988 | Damann |
| 5,141,011 | A | * | 8/1992 | Bjerklund et al. |
| 5,259,997 | A | | 11/1993 | Kazuma |

FOREIGN PATENT DOCUMENTS

| | | |
|---|---|---|
| GB | 509492 | 7/1939 |

OTHER PUBLICATIONS

"PARAMIX—Proven Mix Processing For the Beverage Industry," Klöckner KHS.

* cited by examiner

*Primary Examiner*—Scott Bushey
(74) *Attorney, Agent, or Firm*—Fitzpatrick, Cella, Harper & Scinto

(57) ABSTRACT

A carbonation system comprises a vessel for carbonating a liquid, a $CO_2$ supply connected to the vessel so as to create a $CO_2$ atmosphere in the vessel, an inlet diffuser through which the liquid enters the vessel, and an outlet pipe through which the carbonated liquid exits the vessel. The inlet diffuser comprises a plurality of openings arranged on its vertical face, such that when the liquid exits the inlet diffuser through the plurality of openings, the liquid is substantially atomized and the atomized liquid is ejected in a direction that is substantially parallel to the longitudinal axis of the vessel. The plurality of openings can be arranged in horizontal rows so that openings in adjacent rows are not in vertical alignment with each other. In addition, the atomized liquid can be ejected at an upward angle relative to the longitudinal axis of the vessel.

32 Claims, 7 Drawing Sheets

CARBONATION SYSTEM AND METHOD

BACKGROUND OF THE INVENTION

1. Field of Invention

The invention relates generally to a carbonation system for use with beverage mixing and dispensing systems.

2. Description of Related Art

The dispensing of fountain beverages is generally done by either pre-mix systems or post-mix systems. In pre-mix systems, a finished carbonated product is delivered to the customer or merchant from a manufacturer. In post-mix system, concentrate, such as fountain syrup, is delivered to a merchant and then mixed with carbonated water at the point of sale.

In both pre-mix and post-mix systems, the carbonation process is critical for creating a finished product of high quality. It is the carbonation process that causes carbon dioxide ($CO_2$) to be absorbed into the product, thereby imparting the unique flavor and taste of a carbonated beverage.

A goal of post-mix systems is to achieve the same carbonation content that is present in pre-mixed bottles and cans, which typically have a $CO_2$ content of about 3.6 to 4.2 volumes. However, in pre-mix systems there is a substantial amount of loss of $CO_2$ from the carbonated water during mixing and dispensing. Therefore, in order to obtain the same $CO_2$ levels as are present in pre-mixed bottles and cans, it is desired to increase the $CO_2$ content in the post-mix carbonated water to about 4.7 to 5.5 volumes.

Carbonation systems are used in both pre-mix and post-mix systems. In both systems, the product is usually carbonated by injecting water into a $CO_2$ environment in order for the water to absorb the $CO_2$. There are many types of such carbonation systems in existence. For example, U.S. Pat. No. 2,588,677 (Welty, et al.), incorporated herein by reference, describes a liquid carbonator in which a nozzle injects water at a downward angle into a horizontal tank. However, because the water is ejected downwardly, it quickly mixes with accumulating water and does not spend sufficient time in the $CO_2$ atmosphere, where carbonation is most effective.

Another carbonation system called Paramix is available from Klöckner KHS of New Berlin, Wis. The Paramix system is a pre-mix beverage processing system that is used for beverage can and bottle filling equipment. In this system, water is first deaerated in a two-stage deaeration vessel. Proportioned syrup and deaerated water enter a common line at a mix reservoir and are pumped to a carbonation tank. The mixed water and syrup product is diffused into the carbonation tank under pressure and the diffused product absorbs $CO_2$ from the ambient $CO_2$ atmosphere. The mixed product is diffused by being sprayed through an inlet diffuser. The holes in the Paramix diffuser, however, are arranged so that the product is ejected perpendicular to the longitudinal axis of the vessel. In addition, because the Paramix system is used for can and bottle filling equipment, it is not suitable for adaption to post-mix systems. For example, it uses a much greater carbonator tank volume and flow rate.

Because it is important that the finished product be sufficiently carbonated, there is a constant need for systems that are able produce carbonated product with a higher carbonating efficiency. Moreover, increasing the efficiency of the carbonation system allows for greater design flexibility. For example, by maximizing the carbonation efficiency, a carbonation system can operate at lower liquid supply pressures. Such a reduction in the required liquid supply pressure allows for greater flexibility in the selection of a liquid supply pump. Since pumps that operate at lower liquid supply pressures tend to be longer lasting and require fewer service calls, the reliability of the carbonation system can also be increased.

In addition to the demand for an increase in carbonation efficiency, there is a constant industry need to increase the carbonated product flow rate. Increasing the product flow rate, for example, allows a merchant using a post-mix carbonation system to dispense a greater volume of carbonated beverages during peak hours of business. In addition, for a beverage fountain that includes multiple dispensing nozzles, an increased supply of carbonated water can allow more than one nozzle to be used at the same time.

None of the systems discussed above provide for a high carbonation efficiency with maximum product flow. In addition, none of the systems discussed above provide for the benefits of high carbonation efficiency while being easily adaptable to existing designs of post-mix systems.

SUMMARY OF THE INVENTION

This invention addresses the foregoing needs in the art by providing a carbonation system with improved carbonating efficiency and product flow rate.

The present invention provides a system and method for preparing a carbonated product with a high carbonation efficiency.

The present invention also provides a system and method for preparing a carbonated product using a relatively low liquid inlet pressure.

The present invention further provides a carbonation system and method with a high product flow rate.

In a first aspect of the present invention, the carbonation system comprises a vessel for carbonating a liquid, a $CO_2$ supply connected to the vessel so as to create a $CO_2$ atmosphere in the vessel, an inlet diffuser through which the liquid enters the vessel, and an outlet pipe through which the carbonated liquid exits the vessel. The inlet diffuser comprises a plurality of openings arranged on its vertical face. These plurality of openings are configured such that when the liquid exits the inlet diffuser through the plurality of openings, the liquid is substantially atomized and the atomized liquid is ejected in a direction that is substantially parallel to the longitudinal axis of the vessel.

In a second aspect of the present invention, a carbonation system comprises a vessel for carbonating a liquid, a $CO_2$ supply connected to the vessel so as to create a $CO_2$ atmosphere in the vessel, an inlet diffuser through which the liquid enters the vessel, and an outlet pipe through which the carbonated liquid exits the vessel. The inlet diffuser comprises a plurality of openings arranged on its vertical face. These plurality of openings are configured such that when the liquid exits the inlet diffuser through the plurality of openings, the liquid is substantially atomized. Also, the plurality of openings are arranged in horizontal rows such that openings in adjacent rows of the plurality of holes are not in vertical alignment with each other.

In a third aspect of the present invention, a carbonation system comprises a vessel for carbonating a liquid, a $CO_2$ supply connected to the vessel so as to create a $CO_2$ atmosphere in the vessel, an inlet diffuser through which the liquid enters the vessel, and an outlet pipe through which the carbonated liquid exits the vessel. The inlet diffuser comprises a plurality of openings arranged on its vertical face. These plurality of openings are configured such that when the liquid exits the inlet diffuser through the plurality of openings, the liquid is substantially atomized and the atomized liquid is ejected at an upward angle relative to the longitudinal axis of the vessel.

In a fourth aspect of the present invention, a method is provided for carbonating a liquid. This method comprises the steps of providing a vessel for carbonating a liquid, where the longitudinal axis of the vessel is in the horizontal plane, supplying a $CO_2$ atmosphere in the vessel, pumping the liquid into an inlet diffuser to atomize the liquid and eject the atomized liquid into the vessel in a direction that is substantially in the horizontal plane by forcing the liquid through a plurality of openings arranged on a vertical face of the diffuser, and discharging the carbonated liquid out of the vessel.

In a fifth aspect of the present invention, a method is provided for carbonating a liquid. This method comprises the steps of providing a vessel for carbonating a liquid, supplying a $CO_2$ atmosphere in the vessel, atomizing the liquid and ejecting the atomized liquid into the vessel through a plurality of openings arranged on a vertical face of an inlet diffuser, wherein the plurality of openings are arranged in horizontal rows such that openings in adjacent rows of the plurality of openings are not in vertical alignment with each other, and discharging the carbonated liquid out of the vessel.

In a sixth aspect of the present invention, a method is provided for carbonating a liquid. This method comprises the steps of providing a vessel for carbonating a liquid, supplying a $CO_2$ atmosphere in the vessel, atomizing the liquid and ejecting the atomized liquid into the vessel at an upward angle relative to a horizontal plane of the vessel, and discharging the carbonated liquid out of the vessel.

The above, and other aspects, features, and advantages of the present invention will be apparent from the following detailed description of the illustrated embodiments thereof which are to be read in connection with the accompanying drawings wherein:

DETAILED DESCRIPTION OF THE PREFERRED EMBODIMENTS

The present invention relates to a carbonation system preferably to be used with beverage mixing and dispensing systems. In particular, the present invention provides for a carbonation system with improved carbonating efficiency and product flow rate. Because of the improvement in carbonation efficiency, the carbonation system of the present invention may be used with a lower liquid inlet pressure.

First Embodiment

Figure 1:
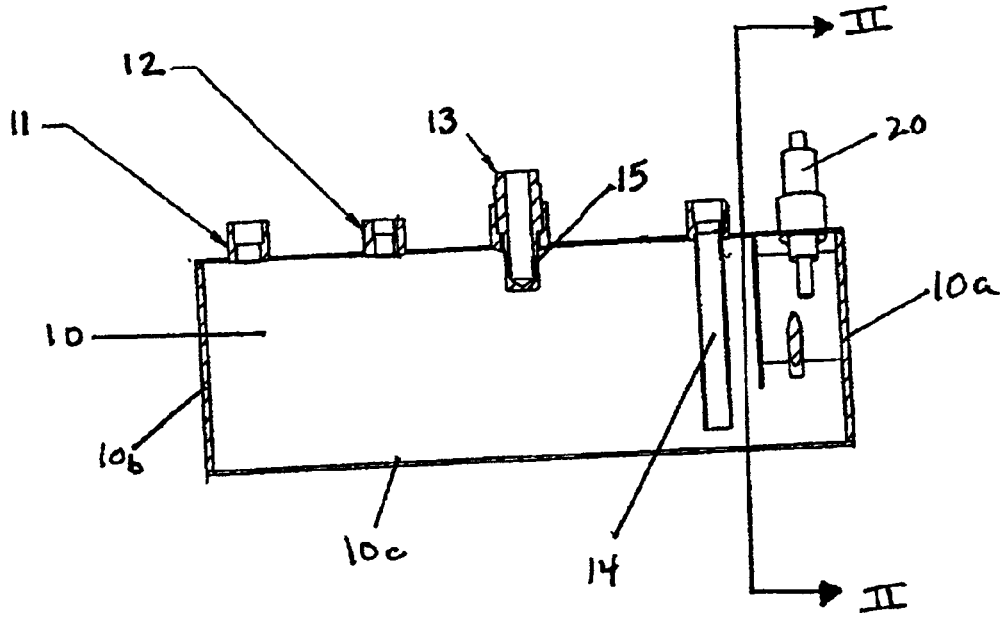
FIG. 1 is a sectional view of an apparatus according to an embodiment of the present invention.

An embodiment of the present invention will now be described with reference to FIG. 1. The carbonation system shown in FIG. 1 comprises a carbonator vessel or tank 10, $CO_2$ supply 11, pressure relief valve 12, an inlet diffuser 13, product outlet pipe 14 and level sensing probes 20, 21.

A $CO_2$ atmosphere is maintained in the vessel by means of the $CO_2$ supply 11. The pressure relief valve 12 is arranged at the top of the vessel to allow for the release of excess pressure to maintain the vessel at a predetermined pressure. Liquid, such as water, is pumped by a liquid supply pump (not shown) into the carbonator vessel 10 through the inlet diffuser 13. The inlet diffuser 13 atomizes the liquid and the atomized liquid droplets are ejected into the $CO_2$ environment that is created by the $CO_2$ supply 11. While the atomized liquid droplets are airborne, they absorb $CO_2$ from the $CO_2$ environment in the carbonator vessel 10. After impacting the vessel walls, the liquid pools in the bottom of the vessel 10. The pooling liquid then exits the vessel 10 through the product outlet pump 14 upon the actuation of a dispensing valve (not shown).

Figure 2:
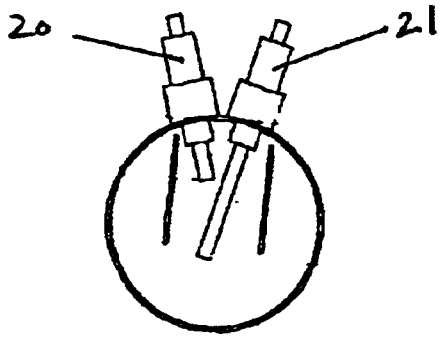
FIG. 2 is a sectional view of the apparatus taken along section line II—II of FIG. 1.

Level sensing probes 20, 21, depicted in FIG. 2, ensure that the product level in the vessel 10 remains within predetermined limits. For example, when the pooling liquid drops below a predetermined level, the lower level sensing probe 21 senses this and more liquid is pumped into the carbonator vessel 10 through the inlet diffuser 13. Similarly, when the pooling liquid rises to a higher predetermined level, the upper sensing probe 20 senses this and the pump is shut off. No more liquid will enter the carbonator vessel 10 until the level of the pooling liquid again drops low enough to trigger to lower sensing probe, thus turning the pump back on.

The carbonator vessel 10 can be easily designed to fit existing designs of post-mix dispensing equipment.

Throughout the system, conventional beverage tubing (FDA approved for use with food products) is used to connect the components of the system.

The vessel 10 is preferably cylindrical in shape, with a horizontal orientation. That is, the longitudinal axis of the vessel is aligned horizontally. As an example, the vessel 10 measures 4 inches in diameter and 12 inches in length along its longitudinal axis. The internal volume of the vessel is 77 ounces (139 $in^3$), for example.

For a fixed $CO_2$ pressure, diffuser position, hole orientation and size, and environmental conditions, the quantity of $CO_2$ absorbed by the liquid will vary with product flow rate. The flow rate is determined by a pressurized source (not shown) that pumps liquid (water, in this example) through the diffuser 13. The pressure source of the present embodiment is preferably a positive displacement pump. However, other pressure sources, such as a centrifugal pump in combination with a pneumatic or mechanical flow control device/valve, could be used. The operating pressure of the pressurized source can be from 20 to 150 psi. Preferably, however, the operating pressure is 50 to 150 psi, and more preferably 100 to 140 psi.

The diffuser 13 is 2 inches long and has an inner diameter of 0.44 inches, for example. The diffuser 13 comprises a series of round holes or openings 15 that are arranged in rows and columns. The outer diameter of the product diffuser 13 is 0.60 inches, for example, at the region of the holes.

The diffuser 13 substantially atomizes the pumped liquid as it exits the holes and the atomized liquid is ejected into the $CO_2$ environment. The atomizing of the liquid in the $CO_2$ atmosphere allows for a very rapid absorption of $CO_2$ by the liquid. Various factors relating to the holes (such as size, number, and orientation) can be selected based on the desired atomizing effect and the desired $CO_2$ absorption levels. In particular, the amount of $CO_2$ absorbed by the atomized liquid depends on exposure time, liquid flow rate, diffuser configuration, diffuser pressure drop, and water temperature.

Since most of the $CO_2$ absorption occurs after the atomized liquid exits the diffuser 13 and before the atomized liquid contacts the vessel walls or the pooled liquid at the bottom of the vessel, the carbonation efficiency can be improved by lengthening the amount of time that the atomized liquid is airborne in the $CO_2$ environment. Thus, by adjusting the diffuser position and the orientation of the exit holes 15 in relation to the product vessel 10, the quantity of $CO_2$ absorbed can be improved. For example, when the diffuser is positioned close to the vessel wall, or the holes are oriented towards the nearest vessel wall, the time available for $CO_2$ absorption is relatively short because the atomized liquid droplets impact the nearest wall before a requisite time period has elapsed to absorb sufficient $CO_2$. Likewise, if the diffuser holes are oriented downwardly toward the pooling liquid at the bottom of the vessel, the available $CO_2$ absorption time is lessened because the ejected droplets hit the pooling liquid prematurely. Consequently, the $CO_2$ content of the product will be lower. Conversely, when the diffuser position is far away from the vessel walls and the atomized liquid is directed toward the farthest wall and not downwardly, the time available for $CO_2$ absorption increases and the $CO_2$ content of the product will increase.

In this embodiment, the diffuser 13 is located at the longitudinal center of the vessel 10 and is oriented substantially perpendicular to the longitudinal axis of the vessel. The hole orientation of the diffuser 13 is substantially parallel to the longitudinal axis of the vessel 10 or at angles that slightly diverge from the longitudinal axis such that the ejected liquid droplets are aimed at end walls 10*a*, 10*b* of the vessel or at regions of the side wall 10*c* adjacent to the end walls. With this particular arrangement, the amount of time the atomized product is airborne in the $CO_2$ environment is maximized because the atomized liquid can travel a greater distance before impacting the walls of the vessel 10. Since lengthening the exposure time of the atomized liquid droplets increases the amount of $CO_2$ that the atomized liquid droplet absorbs, the carbonation efficiency is thereby improved.

However, the diffuser 13 could also be positioned at either end of the vessel 10, with a corresponding relocation of the holes so that the exit direction maximizes the amount of time that the atomized liquid is airborne in the $CO_2$ environment.

Figure 3:
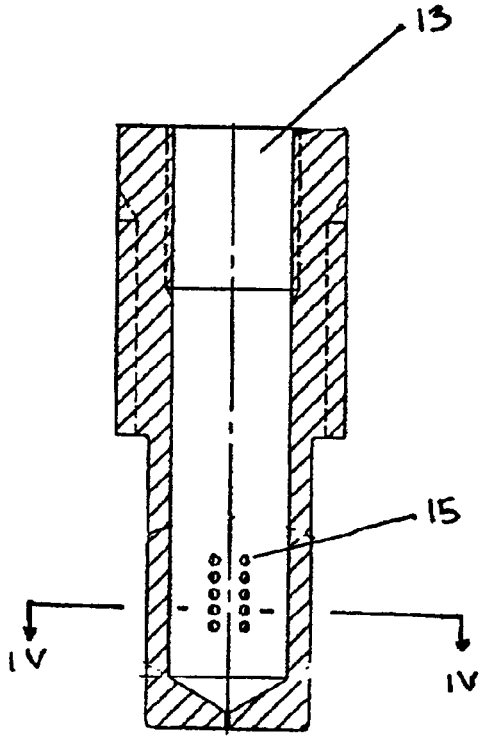
FIG. 3 is a sectional view of an inlet diffuser of the first embodiment.
Figure 4:
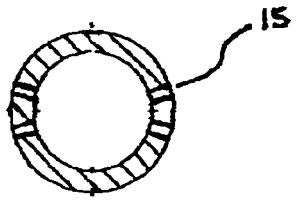
FIG. 4 is a sectional view taken along section line IV—IV of FIG. 3 showing the hole orientation of the inlet diffuser of the first embodiment.

An assortment of hole numbers and orientations are envisioned. For example, hole orientation angles can vary from 0 to 360 degrees about the vertical axis of the diffuser 13. One preferable arrangement is depicted in FIGS. 3 and 4. In this arrangement, there are twenty holes 15 in the diffuser 13 arranged in five rows of four holes. Each hole 15 diameter is 0.036 inches, for example. The holes 15 are oriented on the rows at 15, 165, 195, and 345 degrees with the longitudinal axis of the vessel being oriented at 0 degrees.

Figure 5:
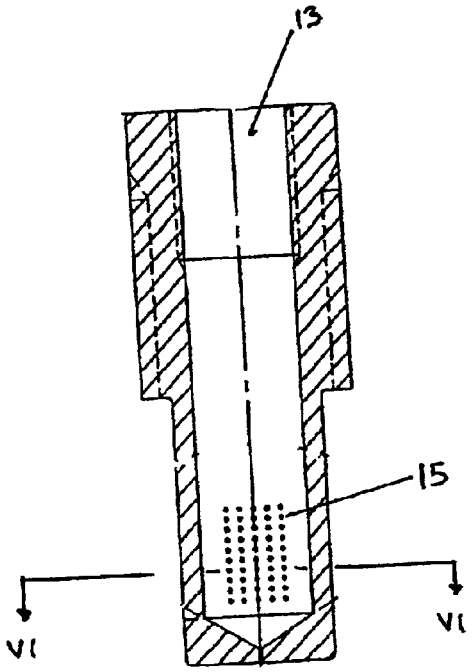
FIG. 5 is a sectional view of a modification of the inlet diffuser of the first embodiment.
Figure 6:
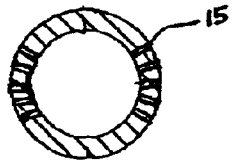
FIG. 6 is a sectional view taken along section line VI—VI of FIG. 5 showing the hole orientation of the modified inlet diffuser of the first embodiment.

As the number of exit holes 15 on a particular diffuser increases, however, the diameter of each hole generally decreases. For example, FIGS. 5 and 6 depict a modified configuration. This configuration comprises 100 holes 15, each with a hole diameter of 0.016 inches. Also, as depicted in FIG. 6, the holes 15 are oriented along the rows at 0, 15, 30, 150, 165, 180, 195, 210, 330, and 345 degrees.

The pressure drop across the diffuser depends on the flow rate, hole size, and the number of holes. The flow range of the system can vary between 4.4–13.3 oz. per second, but preferably is between 4.5–8.2 oz. per second. The diffuser 13 pressure drop range is 5–80 psi, but preferably is between 15–40 psi.

Second Embodiment

Figure 7:
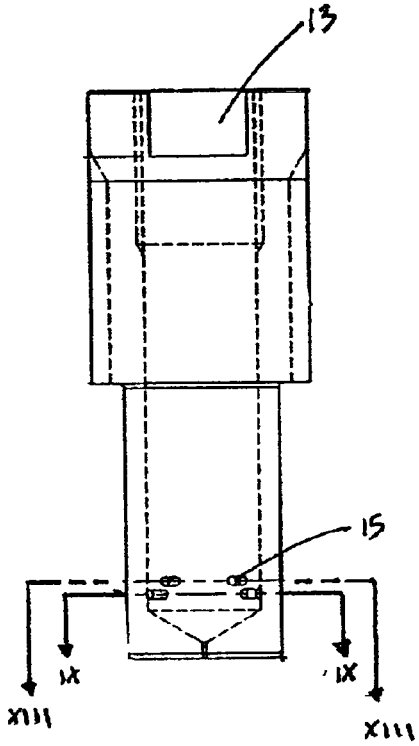
FIG. 7 is a view showing an inlet diffuser of a second embodiment of the present invention.
Figure 8:
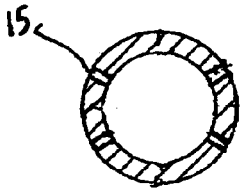
FIG. 8 is a sectional view taken along section line VIII—VIII of FIG. 7 showing the hole orientation of a first row of openings of the inlet diffuser of the second embodiment.
Figure 9:
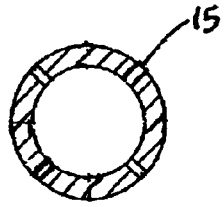
FIG. 9 is a sectional view taken along section line IX—IX of FIG. 7 showing the hole orientation of a second row of openings of the inlet diffuser of the second embodiment.

One problem with inlet diffusers that can lead to inefficient carbonation is that, if the various exit holes are oriented too close to one another, the corresponding ejected droplets may collide with one another and combine into larger droplets. This decreases the available liquid surface area for $CO_2$ absorption. To overcome this problem, in a second embodiment, the diffuser 13 comprises two rows of holes 15 with a staggered arrangement. Each hole 15 has a diameter of 0.036 inches, for example. In particular, in FIGS. 7, 8, and 9, a preferable arrangement is depicted with a first row having exit holes 15 at 30, 150, 210, and 330 degrees, and a second row having exit holes 15 at 45, 135, 225, and 315 degrees. This staggered arrangement is preferable in that it prevents water droplets from contacting one another prematurely and, therefore, allows for more efficient carbonation. This staggered diffuser can improve carbonation efficiency in any carbonator, including those with vertically-oriented carbonation vessels.

Figure 10:
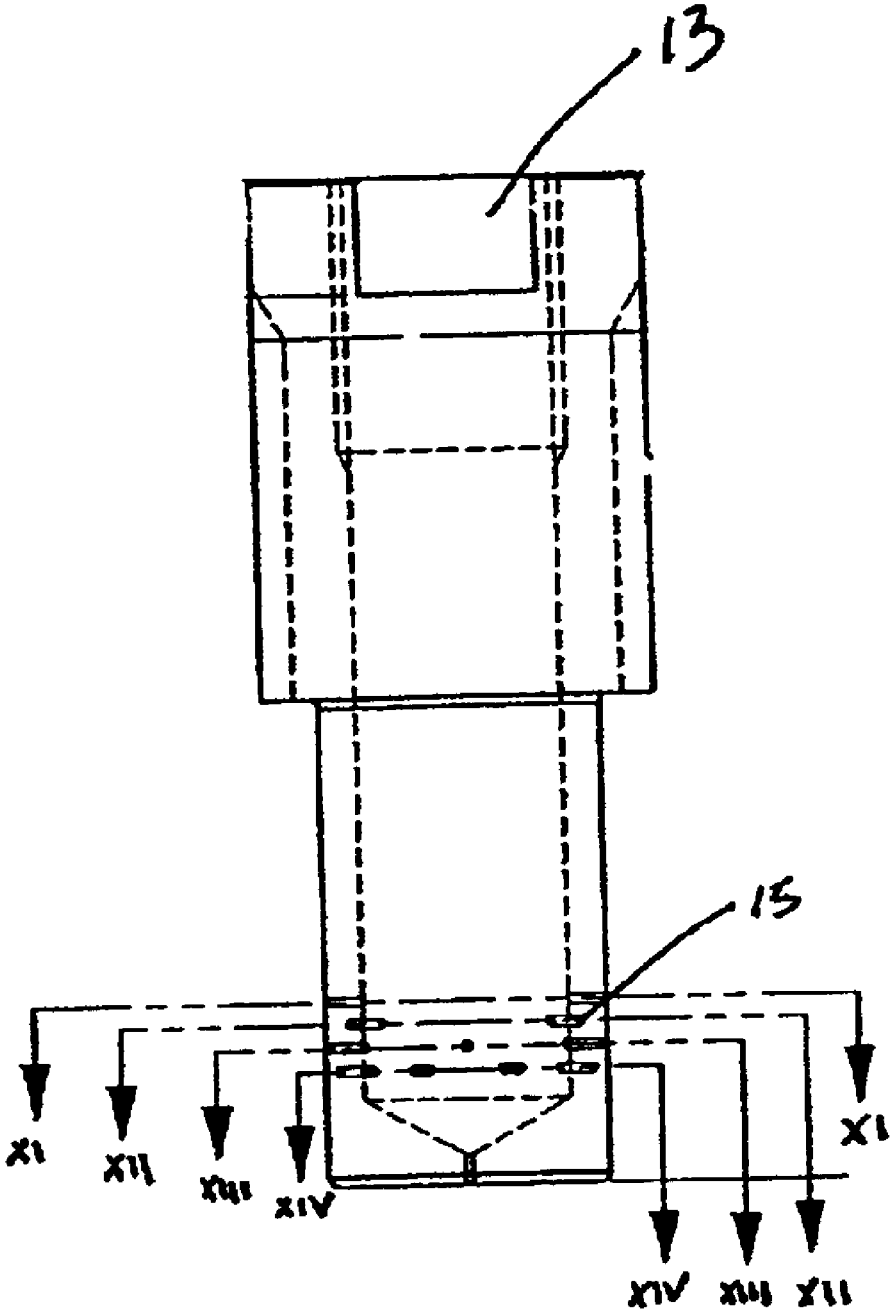
FIG. 10 is a view showing a modification of the inlet diffuser of the second embodiment.
Figure 11:
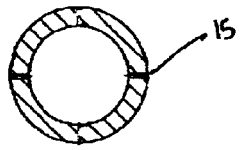
FIG. 11 is a sectional view taken along section line XI—XI of FIG. 10 showing the hole orientation of a first row of openings of the modified inlet diffuser of the second embodiment.
Figure 12:
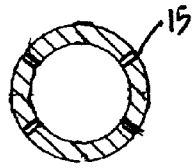
FIG. 12 is a sectional view taken along section line XII—XII of FIG. 10 showing the hole orientation of a second row of openings of the modified inlet diffuser of the second embodiment.
Figure 13:
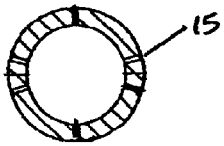
FIG. 13 is a sectional view taken along section line XIII—XIII of FIG. 10 showing the hole orientation of a third row of openings of the modified inlet diffuser of the second embodiment.
Figure 14:
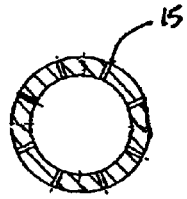
FIG. 14 is a sectional view taken along section line XIV—XIV of FIG. 10 showing the hole orientation of a fourth row of openings of the modified inlet diffuser of the second embodiment.

The number and arrangement of the holes 15 can vary. For example, in FIG. 10, a modified arrangement is shown where the diffuser comprises four rows of holes 15 with a staggered arrangement. Each hole 15 has a diameter of 0.02 inches, for example. As depicted in FIGS. 11, 12, 13, and 14, the arrangement of the exit holes 15 is varied from row to row. The first row, as shown in FIG. 11, has exit holes 15 at 0 and 180 degrees. The second row, as shown in FIG. 12, has exit holes 15 at 35, 145, 215, and 325 degrees. The third row, as shown in FIG. 13, has exit holes 15 at 15, 165, 195, and 345 degrees. The fourth row, as shown in FIG. 14, has exit holes 15 at 25, 65, 115, 155, 205, 245, 295, and 335 degrees.

In this embodiment any number of combinations of holes and orientations are possible, so long as the holes of adjacent rows are not in alignment with each other. Again, as the number of exit holes 15 on a particular diffuser increases, the diameter of each hole generally decreases. This staggered arrangement decreases the likelihood of collisions among the water droplets, thereby increasing the period of time that the water droplets are airborne. Since lengthening the exposure time of the water droplet increases the amount of $CO_2$ that the water droplet absorbs, the carbonation efficiency is thereby improved.

Third Embodiment

Figure 15:
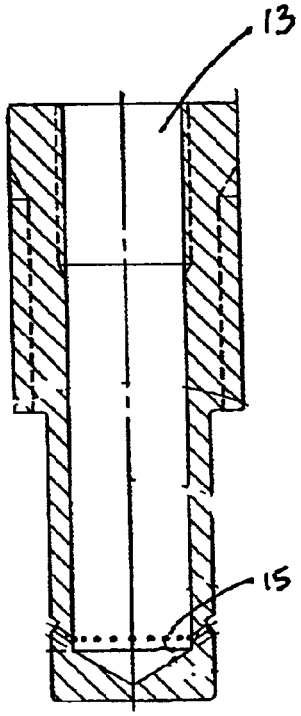
FIG. 15 is a sectional view of an inlet diffuser of a third embodiment of the present invention.
Figure 16:
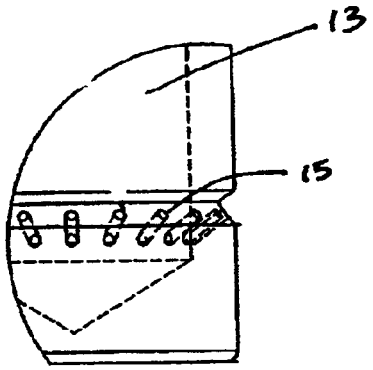
FIG. 16 is a detailed drawing showing the row of openings of the inlet diffuser of the third embodiment.

In a third embodiment the diffuser 13 comprises a row of holes 15 that are oriented at an angle that is upward from the horizontal axis of the vessel 10. The angle is preferably between 35 and 85 degrees, for example. As depicted in FIGS. 15 and 16, the holes 15 can be evenly spaced around the axis of the diffuser 13. A single row contains twenty holes 15, each with a diameter of 0.020 inches, for example. This upwardly-directed arrangement is preferable in that it ejects the atomized liquid droplets at an upward angle so as to lengthen their trajectories before they land in the pooling liquid or impact against the vessel walls. These longer trajectories correspondingly lengthen the amount of time that the water droplets are airborne and, therefore, allows for more efficient carbonation. This upwardly-directed arrangement can improve carbonation efficiency in any carbonator, including those with vertically-oriented carbonation vessels.

It is envisioned, however, that any number of upwardly directed holes (including multiple rows of holes) and a large variety of diameter sizes would be possible. In addition, a staggered arrangement, such as described in the second embodiment could also be utilized along with the upwardly directed holes of the third embodiment.

Although the present invention has been described in terms of the foregoing embodiments, such description has been for exemplary purposes only and, as will be apparent to one of ordinary skill in the art, many alternatives, equivalents, and variations of varying degrees will fall within the scope of the present invention. That scope, accordingly, is not to be limited in any respect by the foregoing description, rather, it is defined only by the claims that follow.

For example, the vessel size may be much larger than that which is described above. It is envisioned that the vessel size could be at least as large as 2500 oz. (4500 $in^3$) and measure at least as large as 12" OD and 12" L, for example. Also, in the preferred embodiment, the vessel cross-section is round; however, other cross-sections, such as square, rectangular, hexagonal, etc., could also be used. In addition, although the preferred embodiment described a product diffuser with a hole, product diffusers with slots instead of holes or slot/hole combinations are also envisioned.

We claim:

1. A carbonation system comprising:

a vessel for carbonating a liquid, the longitudinal axis of said vessel being in a horizontal plane;

a $CO_2$ supply connected to said vessel so as to create a $CO_2$ atmosphere in said vessel;

an inlet diffuser through which the liquid enters said vessel, said inlet diffuser comprising a plurality of openings arranged on a vertical face, wherein the plurality of openings are oriented such that when the liquid exits said inlet diffuser through the plurality of openings, the liquid is substantially atomized and substantially all of the atomized liquid is ejected in a direction that is substantially in a horizontal plane; and an outlet pipe through which the carbonated liquid exits said vessel.

2. A carbonation system according to claim 1, wherein the plurality of openings are holes.

3. A carbonation system according to claim 2, wherein the diameters of the holes are approximately 0.016–0.036 inches.

4. A carbonation system according to claim 1, wherein the inlet liquid pressure is approximately 100 to 140 psi.

5. A carbonation system according to claim 1, wherein said inlet diffuser is positioned in the approximate longitudinal center of said vessel.

6. A carbonation system according to claim 1, wherein said vessel is cylindrical in shape.

7. A carbonation system according to claim 1, wherein the plurality of openings are arranged in a plurality of horizontal rows.

8. A carbonation system according to claim 1, wherein the plurality of openings are oriented to eject the atomized liquid substantially along the longitudinal axis of said vessel.

9. A carbonation system according to claim 1, wherein said vessel comprises end walls at either longitudinal end and the plurality of openings are oriented to eject the atomized liquid toward the end walls of said vessel.

10. A carbonation system according to claim 1, wherein said vessel comprises side walls and end walls at either longitudinal end of said side walls, and the plurality of openings are oriented such that the atomized liquid is not ejected toward the side walls of said vessel.

11. A carbonation system according to claim 1, wherein said vessel comprises side walls and end walls at either longitudinal end of said side walls, and the plurality of openings are oriented such that the atomized liquid is not ejected toward a central region of the side walls of said vessel.

12. A carbonation system comprising:

a vessel for carbonating a liquid, the longitudinal axis of said vessel being in a horizontal plane;

a $CO_2$ supply connected to said vessel so as to create a $CO_2$ atmosphere in said vessel;

an inlet diffuser through which the liquid enters said vessel, said inlet diffuser comprising a plurality of openings arranged on a vertical face, wherein the plurality of openings are oriented such that when the liquid exits said inlet diffuser through the plurality of openings, the liquid is substantially atomized and wherein the plurality of openings are arranged in horizontal rows such that openings in adjacent rows of the plurality of openings are not in vertical alignment with each other, and wherein substantially all of the atomized liquid is ejected in directions that are substantially in horizontal planes; and an outlet pipe through which the carbonated liquid exits said vessel.

13. A carbonation system according to claim 12, wherein adjacent rows of the plurality of openings have a different number of openings per row.

14. A carbonation system according to claim 12, wherein the inlet liquid pressure is approximately 100 to 140 psi.

15. A carbonation system according to claim 12, wherein the plurality of openings are holes.

16. A carbonation system according to claim 15, wherein the diameters of the holes are approximately 0.020–0.036 inches.

17. A carbonation system according to claim 12, wherein said inlet diffuser is positioned in the middle of said vessel.

18. A carbonation system according to claim 12, wherein said vessel is cylindrical in shape.

19. A carbonation system according to claim 12, wherein the plurality of openings are oriented to eject the atomized liquid substantially along the longitudinal axis of said vessel.

20. A carbonation system according to claim 12, wherein said vessel comprises end walls at either longitudinal end and the plurality of openings are oriented to eject the atomized liquid toward the end walls of said vessel.

21. A carbonation system according to claim 12, wherein said vessel comprises side walls and end walls at either longitudinal end of said side walls, and the plurality of openings are oriented such that the atomized liquid is not ejected toward the side walls of said vessel.

22. A carbonation system according to claim 12, wherein said vessel comprises side walls and end walls at either longitudinal end of said side walls, and the plurality of openings are oriented such that the atomized liquid is not ejected toward a central region of the side walls of said vessel.

23. A method for carbonating a liquid comprising the steps of:

providing a vessel for carbonating a liquid, where the longitudinal axis of the vessel is in a horizontal plane;

supplying a $CO_2$ atmosphere in the vessel;

pumping the liquid into an inlet diffuser to atomize the liquid and eject substantially all of the atomized liquid into the vessel in a direction that is substantially in a horizontal plane by forcing the liquid through a plurality of openings arranged on a vertical face of the diffuser; and discharging the carbonated liquid out of the vessel.

24. A method according to claim 23, wherein the atomized liquid is ejected substantially along the longitudinal axis of the vessel.

25. A method according to claim 23, wherein the vessel comprises end walls at either longitudinal end, and the atomized liquid is ejected toward the end walls of the vessel.

26. A method according to claim 23, wherein the vessel comprises side walls and end walls at either longitudinal end of the side walls, and the atomized liquid is not ejected toward the side walls of the vessel.

27. A method according to claim 25, wherein the vessel comprises side walls and end walls at either longitudinal end of the side walls, and the atomized liquid is not ejected toward a central region of the side walls of the vessel.

28. A method for carbonating a liquid comprising the steps of:

providing a vessel for carbonating a liquid, the longitudinal axis of the vessel being in a horizontal plane;

supplying a $CO_2$ atmosphere in the vessel;

atomizing the liquid and ejecting the atomized liquid into the vessel through a plurality of openings arranged on a vertical face of an inlet diffuser, wherein the plurality of openings are arranged in horizontal rows such that openings in adjacent rows of the plurality of openings are not in vertical alignment with each other, wherein substantially all of the atomized liquid is ejected in directions that are substantially in horizontal planes; and discharging the carbonated liquid out of the vessel.

29. A method according to claim 28, wherein the atomized liquid is ejected substantially along the longitudinal axis of the vessel.

30. A method according to claim 28, wherein the vessel comprises end walls at either longitudinal end, and the atomized liquid is in ejected toward the end walls of the vessel.

31. A method according to claim 28, wherein the vessel comprises side walls and end walls at either longitudinal end of the side walls, and the atomized liquid is not ejected toward the side walls of the vessel.

32. A method according to claim 28, wherein the vessel comprises side walls and end walls at either longitudinal end of the side walls, and the atomized liquid is not ejected toward a central region of the side walls of the vessel.

* * * * *